US011084093B2

(12) United States Patent
Kondoh

(10) Patent No.: US 11,084,093 B2
(45) Date of Patent: Aug. 10, 2021

(54) TI—FE-BASED SINTERED ALLOY MATERIAL AND METHOD FOR PRODUCING SAME

(71) Applicants: Katsuyoshi Kondoh, Minoh (JP); HI-LEX CORPORATION, Takarazuka (JP)

(72) Inventor: Katsuyoshi Kondoh, Minoh (JP)

(73) Assignees: KONDOH, KATSUYOSHI, Osaka (JP); HI-LEX CORPORATION, Hyogo (JP)

( * ) Notice: Subject to any disclaimer, the term of this patent is extended or adjusted under 35 U.S.C. 154(b) by 187 days.

(21) Appl. No.: 16/396,245

(22) Filed: Apr. 26, 2019

(65) Prior Publication Data

US 2019/0375017 A1 Dec. 12, 2019

(30) Foreign Application Priority Data

Jun. 12, 2018 (JP) ..... JP2018-111577

(51) Int. Cl.

| | |
|---|---|
| ***C22C 14/00*** | (2006.01) |
| ***B22F 3/16*** | (2006.01) |
| ***B22F 3/24*** | (2006.01) |

(52) U.S. Cl.

CPC ..... *B22F 3/162* (2013.01); *B22F 3/24* (2013.01); *C22C 14/00* (2013.01); *B22F 2003/248* (2013.01); *B22F 2201/50* (2013.01); *B22F 2301/205* (2013.01); *B22F 2301/35* (2013.01); *B22F 2304/10* (2013.01); *B22F 2998/10* (2013.01)

(58) Field of Classification Search

CPC ..... C22C 14/00; C22C 1/0458; C22F 1/183; B22F 3/162; B22F 3/24

See application file for complete search history.

(56) References Cited

FOREIGN PATENT DOCUMENTS

| | | | |
|---|---|---|---|
| JP | S62263940 | A | 11/1987 |
| JP | 2015101749 | A | 6/2015 |
| JP | 2016113640 | A | 6/2016 |

OTHER PUBLICATIONS

English abstract and English Machine Translation of Seto et al. (JP 2016-113640) (Jun. 23, 2016).*

Takemoto et al., Yoshito, "The Effect of Al Addition on Microstructure and Mechanical Properties of Ti—Fe Alloys," The Journal of the Japan Society of Metals, vol. 76, No. 5, (2012), pp. 332-337.

Yang et al., Y.F., "The Sintering, Sintered Microstructure and Mechanical Properties of Ti—Fe—Si Alloys," Metallurgical and Materials Transaction A (Published online: Jul. 6, 2012), pp. 4896-4906.

Majima et al., Kazuhiko, "The Effect of (α+β)-Quenching on Mechanical Properties of Sintered Ti—Fe Binary Alloys " Powder and Powder Metallurgy, vol. 34, No. 8, (Oct. 1987), pp. 349-354.

* cited by examiner

*Primary Examiner* — Jessee R Roe

(74) *Attorney, Agent, or Firm* — Hauptman Ham, LLP

(57) ABSTRACT

A Ti—Fe-based sintered alloy material including two phases of an α phase and a β phase, in which a content of iron is 0.5% or more and 7% or less on a weight basis, a β phase containing an iron component is dispersed in an independent state in an α phase, an area ratio of the β phase containing an iron component is 60% or less of an entire area, and an equiaxed crystal grain is contained in the α phase.

8 Claims, 12 Drawing Sheets

(a) Pure titanium powder ($d_0$ = 29.3 μm)

(b) Iron (Fe) particles ($d_0$ = 4.5 μm)

(c) Ti−5wt.%Fe

Ti−6wt.%Fe Sintered body

850°C(βSingle-phase region) 900°C(βSingle-phase region)

α-Ti Crystal grain diameter $d_0$ =4.2μm

Area ratio
α phase:53.5%
β phase:45.5%

α-Ti Crystal grain diameter $d_0$ =9.5μm

Area ratio
α phase:59.9%
β phase:40.1%

Ti−6wt.%Fe Sintered body (a) 770℃(α+β Two-phase region)

(b) 850℃(βSingle-phase region)

Ti-8 wt.%Fe Sintered body

Ti−2wt.%Fe−0.5wt.%$TiO_2$ Sintered body

820°C(α+β Two-phase region) 920°C(β Single-phase region)

α-Ti Crystal grain diameter $d_0$=3.2μm

Area ratio
α phase:91.7%
β phase:8.3%

α-Ti Crystal grain diameter $d_0$=72.8μm

Area ratio
α phase:98.8%
β phase:1.2%

Ti−4wt.%Fe−0.5wt.%$TiO_2$ Sintered body

800°C(α+β Two-phase region) 900°C(β Single-phase region)

α-Ti Crystal grain diameter $d_0$ =1.8μm

Area ratio
α phase:82.0%
β phase:18.0%

α-Ti Crystal grain diameter $d_0$ =17.8μm

Area ratio
α phase:81.8%
β phase:18.2%

TI—FE-BASED SINTERED ALLOY MATERIAL AND METHOD FOR PRODUCING SAME

BACKGROUND OF THE INVENTION

(1) Field of the Invention

The present invention relates to a Ti—Fe-based sintered alloy material exhibiting excellent tensile strength property and ductility and a method for producing the same.

(2) Description of Related Art

In control of a structure of a sintered material produced using powder metallurgy, it is known that the formation of local nonuniform (hetero) structure contributes to the development of unique properties.

The inventors of the present invention aim to establish a material design guideline which enables to achieve both high strength and high ductility by forming a hetero structure utilizing an inexpensive element instead of a rare metal in a titanium alloy. In the present invention, attention is paid to iron (Fe) as an inexpensive element.

Ti—Fe-based sintered alloy materials are described in, for example, an article (Non-Patent Literature 1) titled "The Effect of Al Addition on Microstructure and Mechanical Properties of Ti—Fe Alloys" published in The Journal of the Japan Society of Metals, 76 (5) (2012) 332-337, an article (Non-patent Literature 2) titled "The Sintering, Sintered Microstructure and Mechanical Properties of Ti—Fe—Si Alloys" published in METALLURGICAL AND MATERIALS TRANSACTION A (Published online: 6 Jul. 2012) 4896-4906, and an article (Non-patent Literature 3) titled "The Effect of (α+β)-Quenching on Mechanical Properties of Sintered Ti—Fe Binary Alloys" published in "Powder and Powder Metallurgy" Vol 34 No. 8 (October 1987) 349-354.

CITATION LIST

Non-Patent Literatures

Non-Patent Literature 1: article titled "The Effect of Al Addition on Microstructure and Mechanical Properties of Ti—Fe Alloys" published in The Journal of the Japan Society of Metals, 76 (5) (2012) 332-337

Non-patent Literature 2: article titled "The Sintering, Sintered Microstructure and Mechanical Properties of Ti—Fe—Si Alloys" published in METALLURGICAL AND MATERIALS TRANSACTION A (Published online: 6 Jul. 2012) 4896-4906

Non-patent Literature 3: article titled "The Effect of (α+β)-Quenching on Mechanical Properties of Sintered Ti—Fe Binary Alloys" published in "Powder and Powder Metallurgy" Vol 34 No. 8 (October 1987) 349-354

SUMMARY OF THE INVENTION

In Non-Patent Literature 1, a Ti—Fe-based alloy fabricated by a melting method is subjected to a water quenching treatment in a temperature region of 950° C. to 1050° C., and the relationship between the material structure and the tensile strength is investigated. In the method disclosed in this literature, a brittle ω phase is generated since a rapid cooling treatment is conducted, and as a result, the Ti—Fe-based alloy fractures in the elastic region and did not exert ductile behavior in a tension test.

In addition, needle-like α-Ti crystal grains are generated since the temperature region of 950° C. to 1050° C. is the β single-phase temperature region of the Ti alloy In Non-Patent Literature 2, a Ti—Fe—Si alloy is fabricated using powder metallurgy and the relationship between the structure and the tensile strength property is investigated. The value of percentage elongation after fracture of a Ti-3 wt. % Fe sintered material not containing Si is a low value of about 3.5%. This is due to the formation of needle-like α-Ti crystal grains by sintering at 1300° C. in addition to the fact that the relative density of the sintered body is 92.4% and thus the sintered body is not completely densified.

In Non-Patent Literature 3, a Ti—Fe alloy is fabricated using powder metallurgy and the relationship between the structure and the tensile strength property when rapid cooling treatment (water quenching) is conducted under two conditions of the β single-phase temperature region and the α+β two-phase temperature region is investigated. The amount of Fe added is three levels of 2 wt. %, 4 wt. %, and 6 wt. %. The tensile strength increases in association with an increase in the Fe content, but the value of percentage elongation after fracture greatly decreases when the Fe content exceeds 4 wt. %. According to the results on the structure observation, elliptical α-Ti crystal grains having a relatively large aspect ratio (ratio of length to width) are formed although needle-like α-Ti crystal grains are not formed. In addition, a hard rod-like martensite phase (α') is generated from the β phase by the rapid cooling treatment. The ductility of the Ti—Fe-based sintered alloy is decreased by these factors.

Incidentally, it has also been reported that the aspect ratio tends to decrease as compared to a material subjected to a rapid cooling treatment in the β single-phase temperature region and the shape is transited to a shape closer to equiaxed grains as the rapid cooling treatment is conducted in the α+β two-phase temperature region. In addition, the existence of a β phase in a network shape in the matrix is also a factor of a decrease in the ductility.

An object of the present invention is to provide a Ti—Fe-based sintered alloy material exhibiting favorable ductility as well as excellent tensile strength property and a method for producing the same.

Means for Solving the Problems

A Ti—Fe-based sintered alloy material according to the present invention includes two phases of an α phase and a β phase, in which a content of iron (Fe) is 0.5% or more and 7% or less on a weight basis. A β phase containing an iron component is dispersed in an independent state in an α phase. An area ratio of a β phase containing an iron component is 60% or less of an entire area, and an equiaxed crystal grain is contained in an α phase.

A preferred content of iron is 1% or more and 6% or less on a weight basis.

In an embodiment, oxygen is contained in both the α phase and the β phase in a solid solution form, and a content of oxygen is 0.15% or more and 1.5% or less on a weight basis.

In another embodiment, oxygen is contained in both the α phase and the β phase in a solid solution form, and a relational expression below, where [Fe] denotes the content of iron and [O] denotes the content of oxygen, is satisfied.

$$[O] \leq -0.335[Fe]+2.83 \quad \text{(Expression 1)}$$

In a more preferred embodiment, oxygen is contained in both the α phase and the β phase in a solid solution form, and the following relational expression, where [Fe] denotes the content of iron and [O] denotes the content of oxygen, is satisfied.

$$[O] \leq -0.1725[Fe]+1.53 \quad \text{(Expression 2)}$$

A method for producing a Ti—Fe-based sintered alloy material according to the present invention includes the steps of; molding, solidifying, and sintering a mixed powder containing a titanium powder containing Ti as a main component and an iron (Fe) particle; subjecting a sintered body after the sintering to hot plastic working in a temperature region in which an α phase and a β phase exist together; and naturally cooling a sintered body after the hot plastic working.

The hot plastic working is typically working selected from the group consisting of hot extruding, hot forging, hot rolling, and hot isostatic pressing.

The natural cooling is conducted in an air atmosphere and the cooling velocity is in a range of 3 degrees/second to 20 degrees/second.

The present invention having the above configuration can provide a Ti—Fe-based sintered alloy material exhibiting excellent tensile strength property and favorable ductility.

DETAILED DESCRIPTION OF PREFERRED EMBODIMENTS

The experiments conducted by the inventors of the present invention will be described below, and the significance, effects and the like of respective configurations of the present invention will be described based on the experimental results.

[Preparation and Mixing of Starting Materials]

First, a pure Ti powder (purity: 99.6%, median diameter: 29.3 μm) and pure Fe particles (purity: 99.9%, median diameter: 4.5 μm) were prepared as starting materials, and the two were mixed together using a dry ball mill. The number of revolutions of the ball mill was 90 rpm, and the mixing time was 3.6 ks.

As the mix proportion, those in which X in Ti—X wt. % Fe was set to 0, 0.5, 1, 2, 3, 4, 6, 7, 8, 9, and 10 were prepared.

Figure 1:
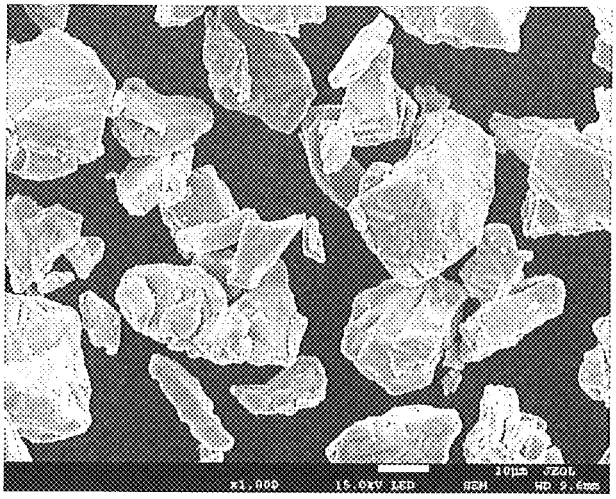
FIG. 1 is photographs which illustrate a pure titanium powder, iron (Fe) particles, and a Ti-5 wt. % Fe powder.
Figure 1:
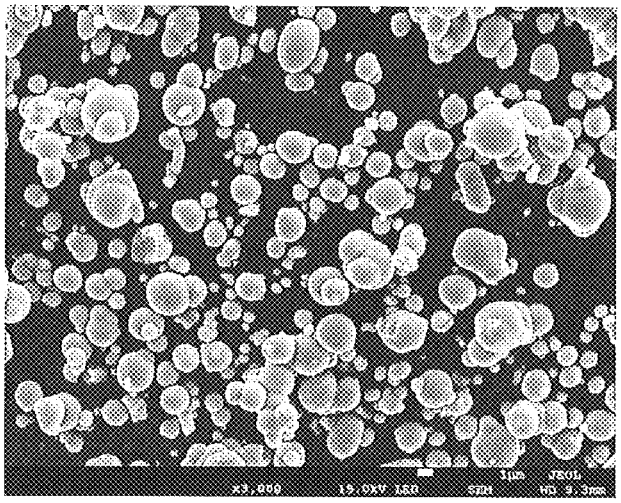
Figure 1:
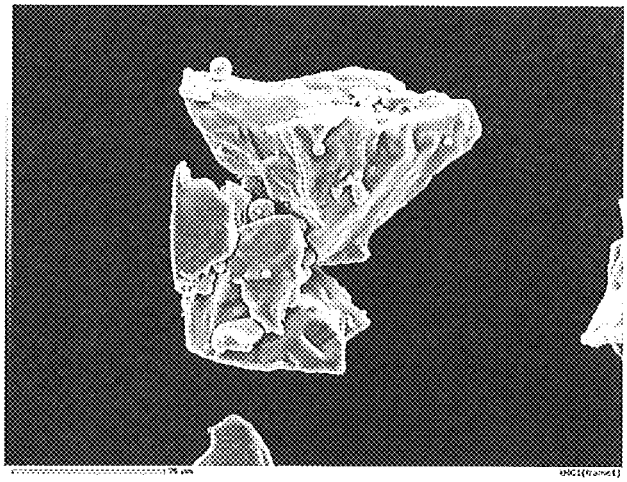

FIG. 1 is an electron micrograph, (a) illustrates a pure Ti powder, (b) illustrates pure Fe particles, and (c) illustrates a mixed powder.

[Sintering]

A Ti—Fe-based sintered alloy including two phases of α+β was fabricated by subjecting the respective mixed powders having different mix proportions to discharge plasma sintering (temperature: 1100° C., pressure: 30 MPa, degree of vacuum: 6 Pa, and time: 3.6 ks).

[Hot Plastic Working]

Subsequently, the respective sintered body samples were preheated at a predetermined temperature for 300 seconds in an argon gas atmosphere and then immediately subjected to hot extruding, thereby fabricating Ti—Fe-based sintered extruded materials having a diameter of 10 mm. As the temperatures for preheating, 770° C. (α+β two-phase temperature region), 800° C. (α+β two-phase temperature region), 820° C. (α+β two-phase temperature region), 850° C. (β single-phase temperature region), 900° C. (β single-phase temperature region), and 920° C. (β single-phase temperature region) were adopted.

[Cooling After Hot Plastic Working]

The sintered extruded material was naturally cooled in an air atmosphere after the hot extruding. The cooling velocity is in a range of 3 degrees/second to 20 degrees/second. As described for comparison, the cooling velocity in rapid cooling such as water quenching is about 50 degrees/second to several hundred degrees/second, and the cooling velocity in slow cooling such as furnace cooling (furnace cooling) is about 1 degree/second or less.

When a rapid cooling treatment (quenching) such as water quenching or oil quenching is conducted in the β single-phase temperature region or the α+β two-phase temperature region, a rod-like fine martensitic phase (α') is generated and this causes a decrease in ductility. The rapid cooling treatment suppresses the growth and coarsening of crystal grains and is effective from the viewpoint of an increase in strength but has a problem from the viewpoint of ductility. In the case of slow cooling such as furnace cooling, coarsening of crystal grains is caused and this leads to a decrease in strength.

An important feature of the present invention is that the sintered material after sintering is subjected to hot plastic working in a temperature region in which the α phase and the β phase exist together and then the sintered body after hot plastic working is subjected to natural cooling in an air atmosphere although it will be described in detail later with reference to the experimental results.

[Shape of α-Ti Crystal Grain]

The ductility decreases in a case in which needle-like α-Ti crystal grains mainly constitute the matrix and it is thus desirable that main crystal grains constituting the matrix are equiaxed grains (equiaxed crystal grains).

The shape of the α-Ti crystal grains is determined by the working and heat treatment temperature to be applied to the material in the last step. In the present invention, the generation of needle-like α-Ti crystal grains is suppressed and the formation of equiaxed grains is mainly promoted as the heating temperature of the materials at the time of hot plastic working is set to a two-phase temperature region of α+β. This is because α phase transformation from the β phase to the α phase occurs in the subsequent cooling process, thus α-Ti crystals coarsely grow and needle-like grains are formed at the same time when working and heat treatment are conducted in the temperature region of β single phase.

In the present invention, the working and heat treatment are conducted in a temperature region not accompanied by phase transformation in the cooling process, thus α-Ti equiaxed grains are formed, and as a result, a decrease in ductility of the titanium material can be suppressed. In addition, brittle & phase and α' phase are not generated since the sintered body after hot plastic working is naturally cooled in an air atmosphere. The fact that these phases are not generated can also be confirmed in the structure photographs to be described later.

[Relationship Between Fe Content and Mechanical Property of Respective Sintered Alloy Extruded Materials]

A Ti—Fe-based sintered alloy extruded material of Ti—X wt. % Fe (X=0 to 10) hot-extruded in a temperature region in which the α phase and the β phase exist together was subjected to a tension test at normal temperature to measure the tensile strength (MPa), 0.2% proof stress (MPa), and percentage elongation after fracture (%).

The Fe content in the sintered alloy extruded materials tested is 0%, 0.5%, 1%, 2%, 3%, 4%, 6%, 7%, 8%, 9%, and 10% on a weight basis.

The above measurement results are shown in Table 1.

TABLE 1

| | Fe content (wt. %) | | | | | | | | | | |
|---|---|---|---|---|---|---|---|---|---|---|---|
| | 0 | 0.5 | 1 | 2 | 3 | 4 | 6 | 7 | 8 | 9 | 10 |
| Tensile strength (MPa) | 615 | 758 | 833 | 877 | 963 | 1134 | 1245 | 1345 | 1573 | 1421 | 941 |
| 0.2% proof stress (MPa) | 522 | 663 | 738 | 794 | 893 | 1069 | 1176 | 1284 | 1550 | 1272 | 917 |
| Percentage elongation after fracture (%) | 34.1 | 29.3 | 32.6 | 31.7 | 33.1 | 26.9 | 23.8 | 10.3 | 1.5 | 0.1 | 0 |

Figure 2:
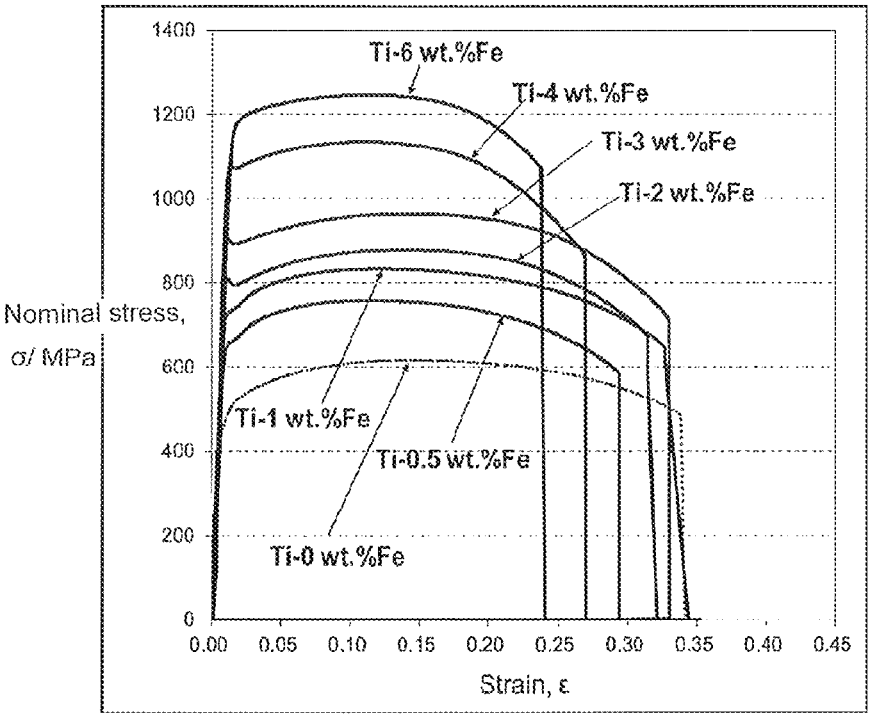
FIG. 2 is a stress-strain diagram.
Figure 3:
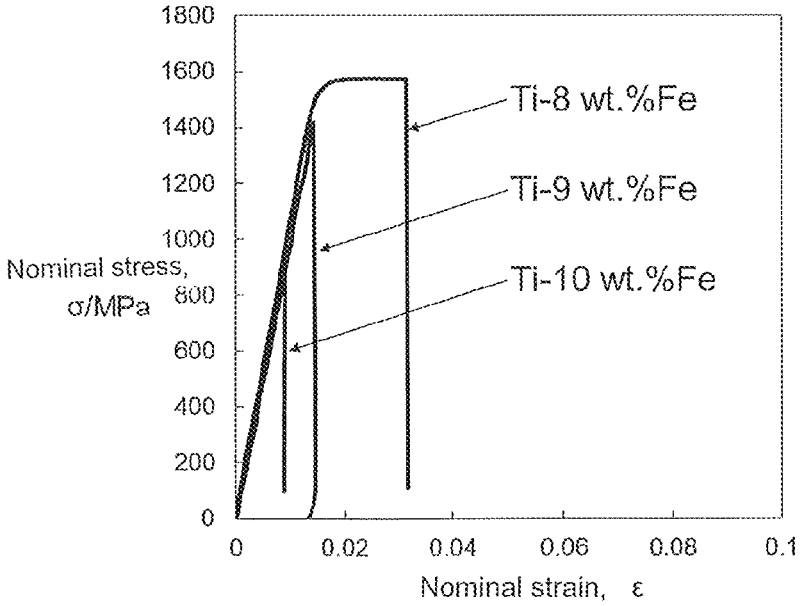
FIG. 3 is a stress-strain diagram.

FIG. 2 illustrates the stress-strain diagrams of Ti-0 wt. % Fe, Ti-0.5 wt. % Fe, Ti-1 wt. % Fe, Ti-2 wt. % Fe, Ti-3 wt. % Fe, Ti-4 wt. % Fe, and Ti-6 wt. % Fe, and FIG. 3 illustrates the stress-strain diagrams of Ti-8 wt. % Fe, Ti-9 wt. % Fe, and Ti-10 wt. % Fe.

As shown in Table 1, FIG. 2, and FIG. 3, it is acknowledged that the tensile strength and 0.2% proof stress of the Ti—Fe-based sintered alloy extruded material increase as the Fe content increases in a Fe content range of 0% to 8% on a weight basis. It is also acknowledged that the tensile strength and 0.2% proof stress decrease when the Fe content exceeds 8%.

With regard to the percentage elongation after fracture, it is acknowledged that the elongation value of the Ti—Fe-based sintered alloy extruded material decreases along with an increase in the Fe content. It is also acknowledged that the elongation value of 10% or more can be maintained when the Fe content is 7% or less and the elongation value rapidly decreases when the Fe content is 8% or more. The elongation value of the Ti—Fe-based sintered alloy extruded material can be maintained at 20% or more when the Fe content is 6% or less.

Fe is a β-phase stabilizing element and contributes to the generation of hard β phase. At the same time, the formation of β phase in the matrix suppresses coarsening of α-Ti crystal grains and contributes to an increase in strength of the Ti—Fe-based sintered alloy material by crystal grain refinement.

When the Fe content is less than 0.5% on a weight basis, the amount of the β phase generated is small, and as a result, the refinement and increase in strength of the α-Ti crystal grains do not sufficiently act, and thus improvement in the strength property of the Ti—Fe-based sintered alloy material cannot be expected. Even when the Fe content exceeds 7%, the tensile strength and the 0.2% proof stress increase but the percentage elongation after fracture (ductility) decreases.

Incidentally, in a case in which a Ti—Fe-based alloy material is fabricated using a melting method, a TiFe compound and the like are generated in the solidification process and concentrated and segregated in a grain boundary to cause a decrease in strength and ductility of the material. On the other hand, by powder metallurgy, the material is fabricated in a completely solid-phase state and thus the above compound is not generated.

In order to obtain a Ti—Fe-based sintered alloy material exhibiting excellent tensile strength property and ductility, it is required to set the content of iron (Fe) to 0.5% or more and 7% or less on a weight basis, and it is more preferable to set the content of iron (Fe) to 1% or more and 6% or less on a weight basis.

[Relationship Between Fe Content in Respective Sintered Alloy Extruded Materials and Area Ratios of α Phase and β Phase]

A Ti—Fe-based sintered alloy extruded material of Ti—X wt. % Fe (X=0 to 10) hot-extruded in a temperature region in which the α phase and the β phase exist together was subjected to EBSD analysis to examine the area ratio of α phase and the area ratio of β phase.

The results are shown in Table 2.

TABLE 2

| | Fe content (wt. %) | | | | | | | | | | |
|---|---|---|---|---|---|---|---|---|---|---|---|
| | 0 | 0.5 | 1 | 2 | 3 | 4 | 6 | 7 | 8 | 9 | 10 |
| Area ratio of α phase (%) | 100 | 98.2 | 96.0 | 93.0 | 83.8 | 76.1 | 51.6 | 40.8 | 31.6 | 22.7 | 14.4 |
| Area ratio of β phase (%) | 0 | 1.8 | 4.0 | 7.0 | 16.2 | 23.9 | 48.4 | 59.2 | 68.4 | 77.3 | 85.6 |

As shown in Table 2, it is acknowledged that the area ratio of β phase increases as the Fe content increases. It is also acknowledged that the area ratio of β phase exceeds 60% when the Fe content exceeds 7%.

In a Ti—Fe-based sintered alloy material including two phases of an α phase and a β phase, an iron component (Fe atom) forms a solid solution in the β phase. For this reason, the β phase is harder and more rigid than the α phase. When the measurement results shown in Table 1 are taken into consideration, it is acknowledged that the ductility of the Ti—Fe-based sintered alloy material decreases as a network of β phase is formed when the area ratio of β phase exceeds 60%.

[Relationship Between Fe Content and Micro-Vickers Hardness in Ti—Fe-Based Sintered Alloy Material]

The relationship between the Fe content and the micro-Vickers hardness in a Ti—Fe-based sintered alloy extruded material of Ti—X wt. % Fe (X=0 to 10) hot-extruded in a temperature region in which the α phase and the β phase exist together was examined. The results are illustrated in FIG. 4.

Figure 4:
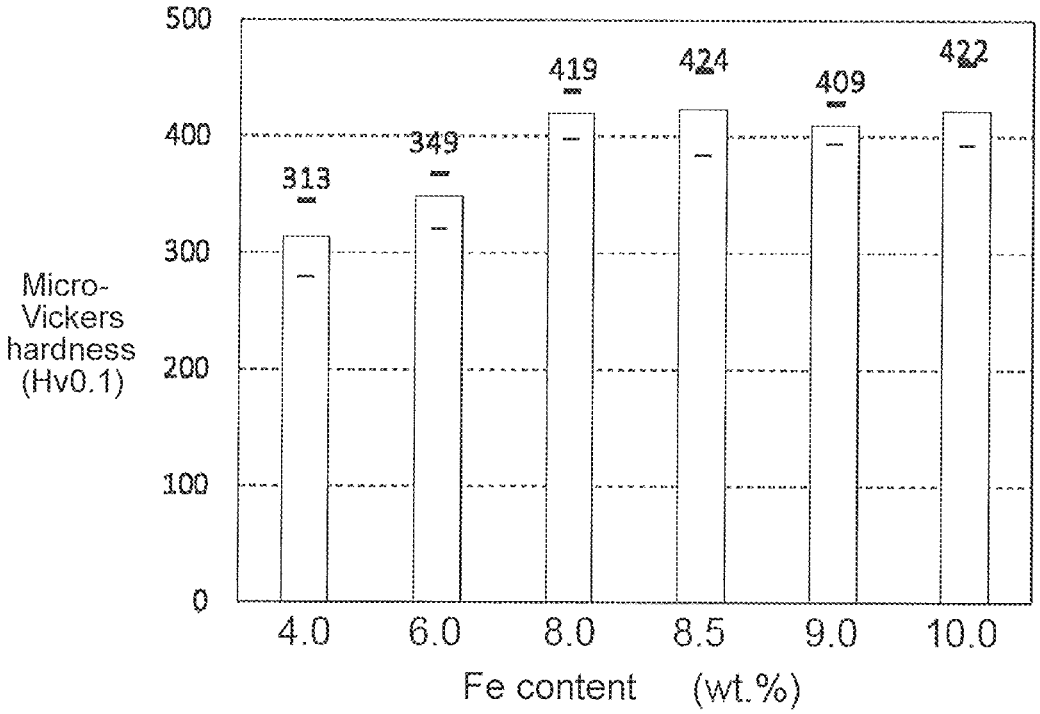
FIG. 4 is a graph which illustrates the relationship between the Fe content and the micro-Vickers hardness.

As illustrated in FIG. 4, the micro-Vickers hardness of the material increases along with an increase in the Fe content, but the micro-Vickers hardness exceeds 400 HV to be saturated and the material becomes brittle when the Fe content is 8 wt. % or more.

[Effect of Working Temperature Region on Crystal Structure of Ti-6 wt. % Fe Sintered Alloy Material]

Figure 5:
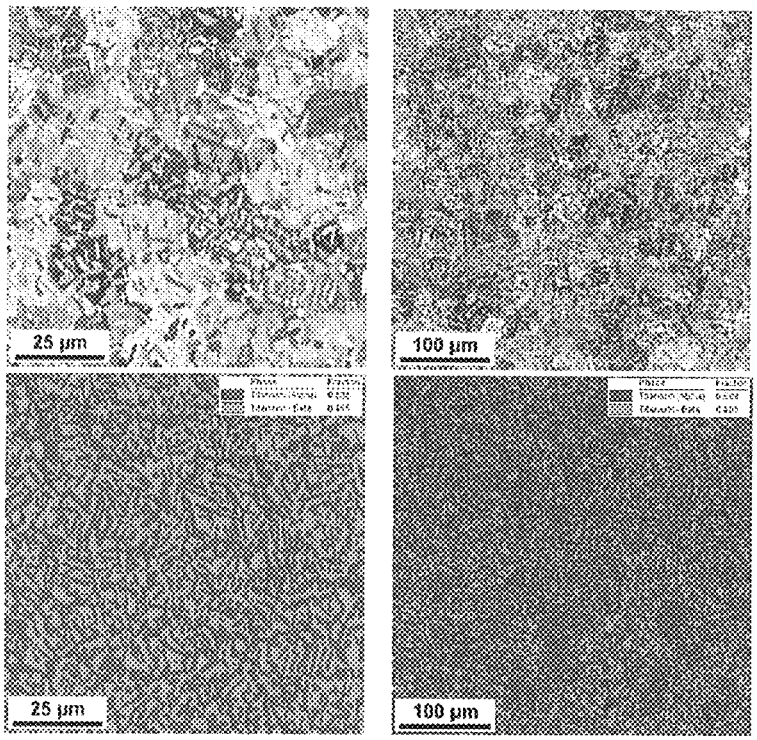
FIG. 5 is a crystal grain map of a Ti-6 wt. % Fe sintered alloy material by EBSD (electron backscatter diffraction) analysis.

A Ti-6 wt. % Fe-based sintered alloy material was subjected to hot extruding at 850° C. (β single-phase temperature region) and 900° C. (β single-phase temperature region). The extruded material was naturally cooled in an air atmosphere after the hot extruding. FIG. 5 is a crystal grain map of a Ti-6 wt. % Fe sintered alloy material by EBSD analysis.

In the case of Ti-6 wt. % Fe, 850° C. and 900° C. are the β single-phase temperature region in which only the β phase exists. When hot extruding is conducted in this β single-phase temperature region and then natural cooling is conducted in an air atmosphere, α-Ti crystal grains coarsely grow and needle-like crystal grains are formed at the same time as illustrated in FIG. 5.

The area ratios of the α phase and the β phase in the material obtained by conducting hot extruding at 850° C. and natural cooling were 53.5% for the α phase and 45.5% for the β phase. The average grain diameter of α-Ti crystal grains is 4.2 μm. The area ratios in the material obtained by conducting hot extruding at 900° C. and natural cooling were 59.9% for the α phase and 40.1% for the β phase. The average grain diameter of the α-Ti crystal grains is 9.5 μm.

Figure 6:
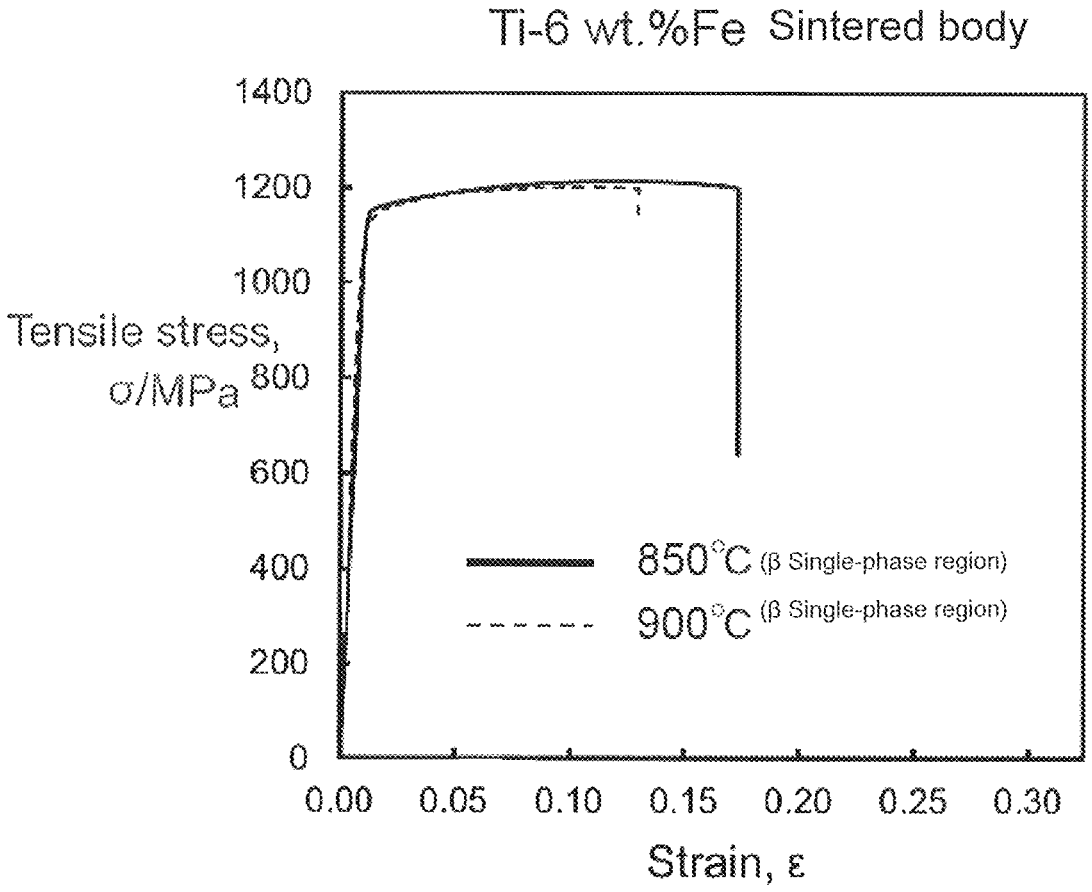
FIG. 6 is a stress-strain diagram of a Ti-6 wt. % Fe sintered body.

FIG. 6 is a stress-strain diagram of the Ti-6 wt. % Fe. As can be seen from this figure, the elongation value of the material decreases when coarse needle-like α-Ti crystal grains are generated.

Figure 7:
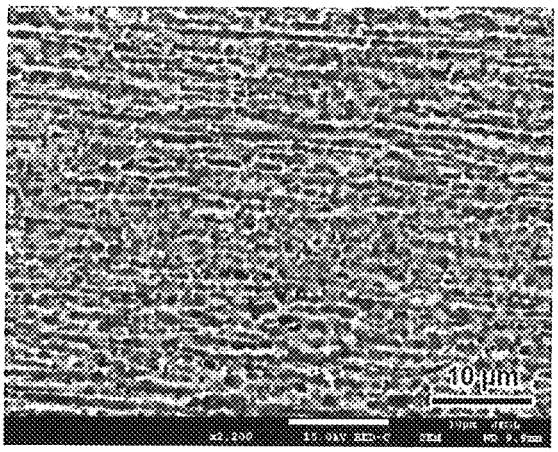
FIG. 7 is a crystal grain map of a Ti-6 wt. % Fe sintered alloy extruded material by EBSD analysis.
Figure 7:
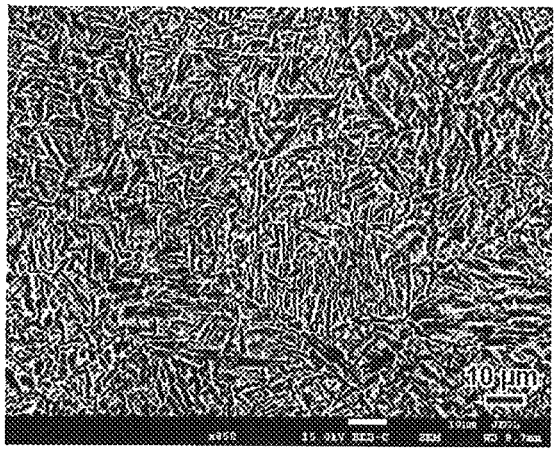

FIG. 7 is a diagram for comparing the crystal grain maps of Ti-6 wt. % Fe sintered alloy materials obtained by conducting hot extruding at 770° C. (α+β two-phase temperature region) and 850° C. (β single-phase temperature region) by EBSD analysis to each other. For both samples, the extruded materials were naturally cooled in an air atmosphere after hot extruding.

As can be seen from FIG. 7, the material obtained by conducting hot extruding in the α+β two-phase temperature region and natural cooling has equiaxed crystal grains while the material obtained by conducting hot extruding in the β single-phase temperature region and natural cooling has needle-like crystal grains. These α-Ti equiaxed crystal grains suppress a decrease in ductility of the Ti—Fe-based sintered alloy material.

[Dispersion State (Formation of β Phase Network) of a Phase and β Phase in Ti-8 wt. % Fe Sintered Alloy Material]

Figure 8:
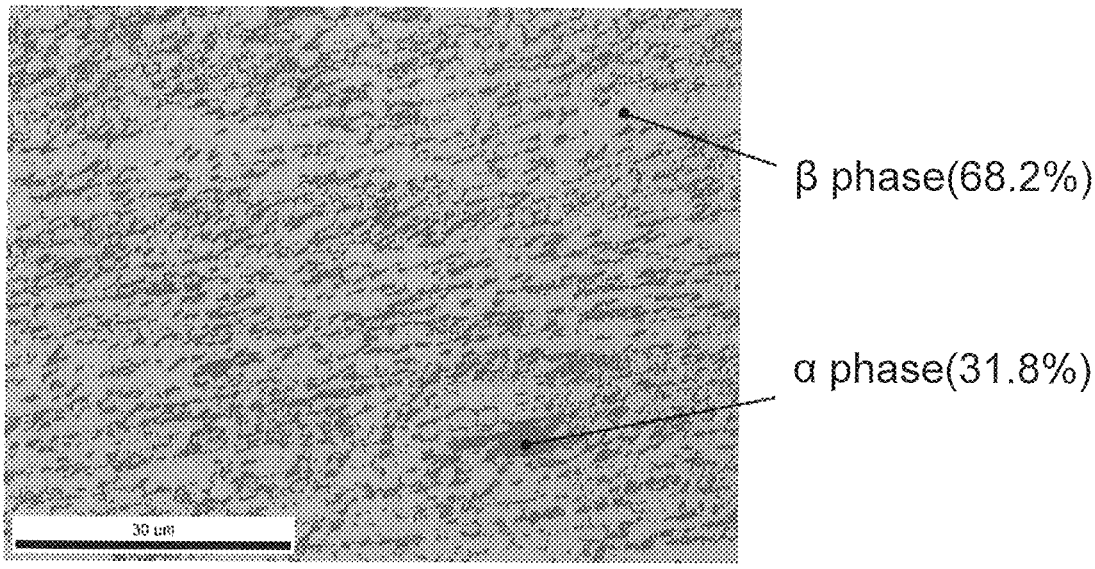
FIG. 8 is a crystal grain map of a Ti-8 wt. % Fe sintered alloy extruded material by EBSD analysis.

FIG. 8 illustrates a crystal grain map of a Ti-8 wt. % Fe sintered alloy material obtained by conducting hot extruding in the α+β two-phase temperature region and then natural cooling by EBSD analysis. The area ratio is 31.8% for the α phase and 68.2% for the β phase. As illustrated in the figure, the area ratio of the β phase containing Fe increases to about 68%, and a network of β phase is formed when the content of Fe is 8 wt. %. For this reason, the ductility of the Ti—Fe-based sintered material decreases.

In order to suppress a decrease in ductility of the Ti—Fe-based sintered material, the β phase containing Fe is required to be dispersed in an independent state in the α phase but does not form a network. In order to realize such a structure, it is required to set the content of Fe to 7% or less on a weight basis and the area ratio of the β phase containing Fe to 60% or less of the entire area.

[Improvement in Strength of Ti—Fe-Based Sintered Alloy Material by Oxygen Solid Solution]

Oxygen is an α-phase stabilizing element and contributes to an increase in strength of the sintered alloy material by forming a solid solution in α-Ti crystal grains. In addition, oxygen contributes to an increase in hardness of the β phase in the same manner by forming a solid solution in the β phase as well. $TiO_2$ particles are preferably used as a supply source of oxygen to form a solid solution. $TiO_2$ particles, which are one of the raw material powders, are thermally decomposed in the sintering process, and the dissociated oxygen atoms form a solid solution in the α phase and the β phase.

For a Ti—Fe-based sintered alloy material in which oxygen is contained in a solid solution form as well, it is required to conduct hot plastic working in the α+β two-phase temperature region and then natural cooling in an air atmosphere.

Figure 9:
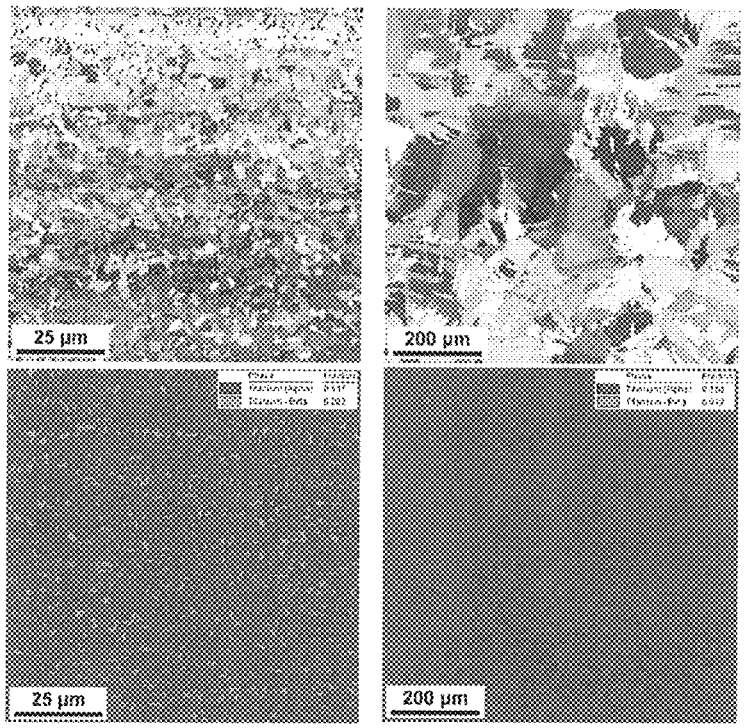
FIG. 9 is a crystal grain map of a Ti-2 wt. % Fe-0.5 wt. % $TiO_2$ sintered alloy extruded material by EBSD analysis.

FIG. 9 illustrates crystal grain maps of Ti-2 wt. % Fe-0.5 wt. % $TiO_2$ sintered alloy materials obtained by conducting hot extruding at 820° C. (α+β two-phase temperature region) and 920° C. (β single-phase temperature region) and then natural cooling by EBSD analysis.

In the sintered alloy material obtained by conducting hot extruding in the β single-phase temperature region (920° C.), the area ratio was 98.8% for the α phase and 1.2% for the β phase. The average grain diameter of the α-Ti crystal grains was 72.8 μm. In addition, as a crystal structure, almost the entire structure is occupied by needle-like crystal grains. The area ratio of β phase is small, but a network of β phase is observed.

In the sintered alloy material obtained by conducting hot extruding in the α+β two-phase temperature region (820° C.), the area ratio is 91.7% for the α phase and 8.3% for the β phase. The average grain diameter of the α-Ti crystal grains is 3.2 μm, and it is acknowledged that the refinement of crystal grains is advanced. In addition, the α-Ti equiaxed crystal grains exist as the crystal structure, and thus the sintered alloy material maintains favorable ductility.

Figure 10:
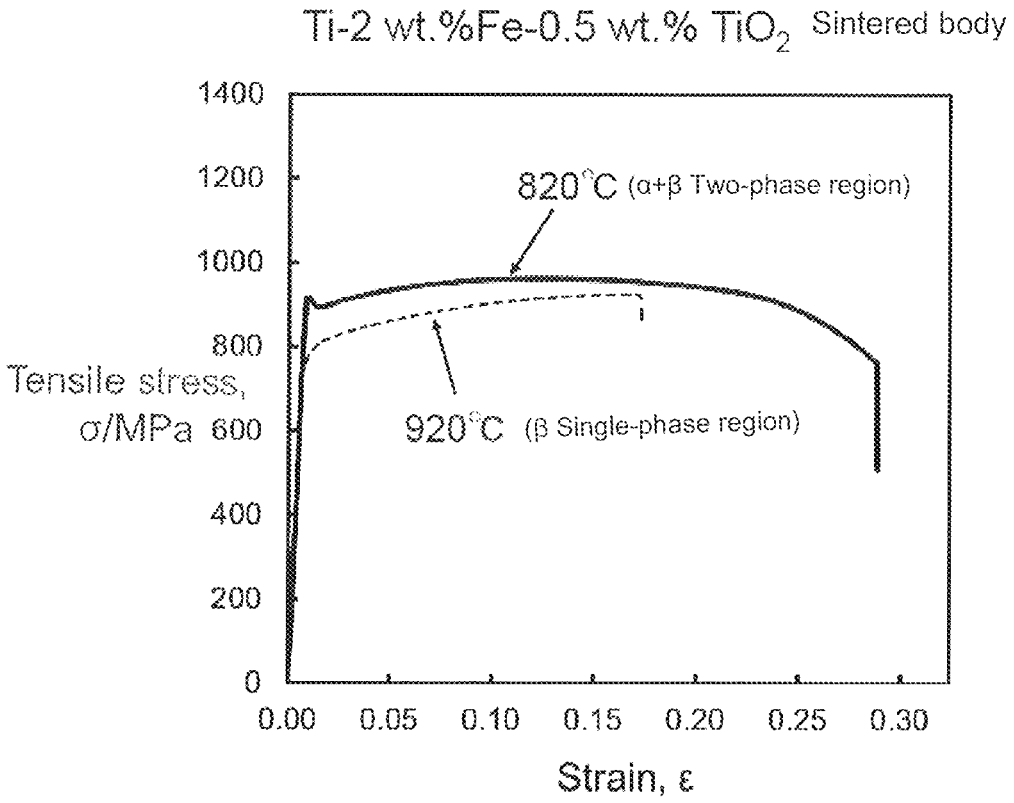
FIG. 10 is a stress-strain diagram of a Ti-2 wt. % Fe-0.5 wt. % $TiO_2$ sintered body.

FIG. 10 is a stress-strain diagram of a Ti-2 wt. % Fe-0.5 wt. % $TiO_2$ sintered alloy material. It is acknowledged that the elongation value of the sintered material obtained by conducting hot extruding at 820° C. (α+β two-phase temperature region) is higher than that of the sintered material obtained by conducting hot extruding at 920° C. (β single-phase temperature region).

Figure 11:
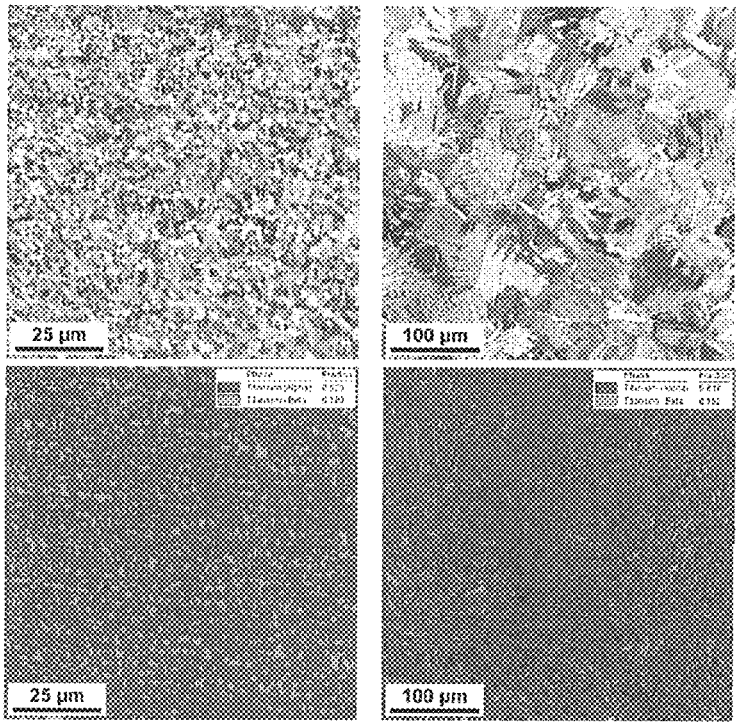
FIG. 11 is a crystal grain map of a Ti-4 wt. % Fe-0.5 wt. % $TiO_2$ sintered alloy extruded material by EBSD analysis.

FIG. 11 illustrates crystal grain maps of Ti-4 wt. % Fe-0.5 wt. % $TiO_2$ sintered alloy materials obtained by conducting hot extruding at 800° C. (α+β two-phase temperature region) and 900° C. (β single-phase temperature region) and then natural cooling by EBSD analysis.

In the sintered alloy material obtained by conducting hot extruding in the β single-phase temperature region (900° C.), the area ratio was 81.8% for the α phase and 18.2% for the β phase. The average grain diameter of the α-Ti crystal grains was 17.8 μm. In addition, as a crystal structure, almost the entire structure is occupied by needle-like crystal grains.

In the sintered alloy material obtained by conducting hot extruding in the α+β two-phase temperature region (800° C.), the area ratio is 82.0% for the α phase and 18.0% for the β phase. The average grain diameter of the α-Ti crystal grains is 1.8 μm, and it is acknowledged that the refinement of crystal grains is advanced. In addition, the α-Ti equiaxed crystal grains exist as the crystal structure, and thus the sintered alloy material maintains favorable ductility.

Figure 12:
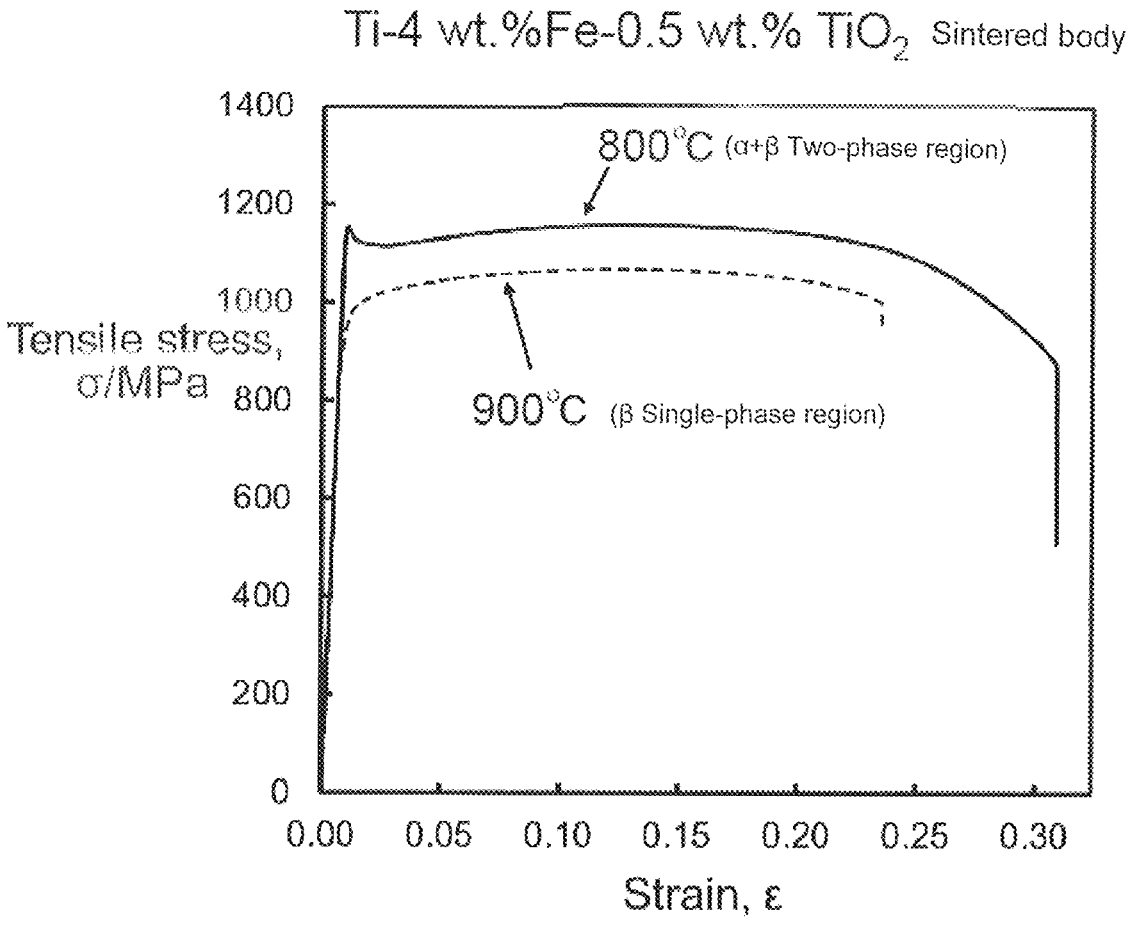
FIG. 12 is a stress-strain diagram of a Ti-4 wt. % Fe-0.5 wt. % $TiO_2$ sintered body.

FIG. 12 is a stress-strain diagram of a Ti-4 wt. % Fe-0.5 wt. % $TiO_2$ sintered alloy material. It is acknowledged that the elongation value of the sintered material obtained by conducting hot extruding at 800° C. (α+β two-phase temperature region) is higher than that of the sintered material obtained by conducting hot extruding at 900° C. (β single-phase temperature region).

In order to improve the strength property of the sintered alloy material by oxygen solid solution, a preferred range of the amount of oxygen to form a solid solution in the sintered alloy material is 0.15 wt. % or more and 0.6 wt. % or less. The effect of improving the strength by oxygen solid solution cannot be expected when the amount of oxygen is less than 0.15 wt. %, and the tensile strength and 0.2% proof stress increase but the value of percentage elongation after fracture decreases when the amount of oxygen exceeds 0.6 wt. %.

Figure 13:
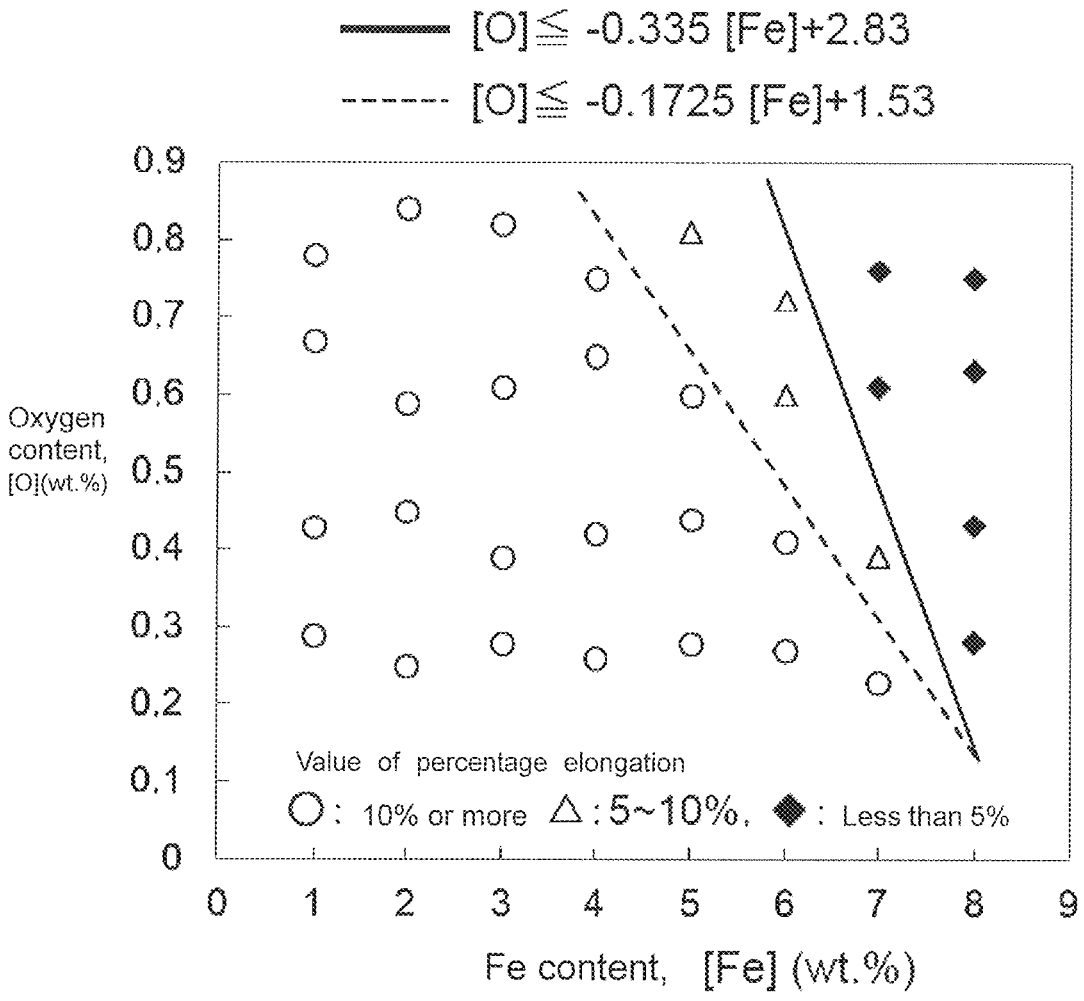
FIG. 13 is a diagram which illustrates the relationship between the Fe content and the oxygen content and the value of percentage elongation after fracture of a Ti—Fe-based sintered alloy material containing oxygen in a solid solution form.

In the case of containing oxygen in the Ti—Fe-based sintered alloy material in a solid solution form, the upper limit value of the content of oxygen depends on the content of Fe. FIG. 13 is a diagram which illustrates the relationship between the Fe content (wt. %) and the oxygen content (wt. %) and the value of percentage elongation after fracture of the Ti—Fe-based sintered alloy material containing oxygen in a solid solution form.

In FIG. 13, "◆" indicates that the value of percentage elongation after fracture of the sintered material is less than 5%, "Δ" indicates that the value of percentage elongation after fracture of the sintered material is 5% or more and less than 10%, and "O" indicates that the value of percentage elongation after fracture of the sintered material is 10% or more.

It is desirable to satisfy the following relational expression, where [Fe] denotes the content of iron (Fe) and [O] denotes the content of oxygen (O), in order to set the elongation value of the Ti—Fe-based sintered alloy material containing oxygen in a solid solution form to 5% or more.

$$[O] \geq -0.335[Fe]+2.83 \quad \text{(Expression 1)}$$

In addition, it is desirable to satisfy the following relational expression in order to set the elongation value of the Ti—Fe-based sintered alloy material containing oxygen in a solid solution form to 10% or more.

$$[O] \leq -0.1725[Fe]+1.53 \quad \text{(Expression 2)}$$

The significance and effects of the respective configurations of the present invention have been described through experiments. The titanium powder used in the experiments was pure titanium but is not limited to pure titanium. One that contains titanium as a main component can be used as the titanium powder of the present invention.

The present invention can be advantageously utilized as a Ti—Fe-based sintered alloy material exhibiting excellent tensile strength property and ductility and a method for producing the same.

What is claimed is:

1. A Ti—Fe-based sintered alloy material comprising two phases of an α phase and a β phase, wherein a content of iron is 0.5% or more and 7% or less on a weight basis, a β phase containing an iron component is dispersed in an independent state in an α phase, an area ratio of the β phase containing an iron component is 60% or less of an entire area, and oxygen is contained in both said α phase and said β phase in a solid solution form, an equiaxed crystal grain is contained in the α phase.

2. The Ti—Fe-based sintered alloy material according to claim 1, wherein a content of said iron is 1% or more and 6% or less on a weight basis.

3. The Ti—Fe-based sintered alloy material according to claim 1, wherein a content of said oxygen is 0.15% or more and 1.5% or less on a weight basis.

4. The Ti—Fe-based sintered alloy material according to claim 1, wherein a relational expression below, where [Fe] denotes a content of said iron and [O] denotes a content of said oxygen, is satisfied.

$$[O] \leq -0.335[Fe]+2.83 \quad \text{(Expression 1)}$$

5. The Ti—Fe-based sintered alloy material according to claim 1, wherein a relational expression below, where [Fe] denotes a content of said iron and [O] denotes a content of said oxygen, is satisfied.

$$[O] \leq -0.1725[Fe]+1.53 \quad \text{(Expression 2)}$$

6. A method for producing a Ti—Fe-based sintered alloy material, comprising the steps of:

molding, solidifying, and sintering a mixed powder containing a titanium powder containing Ti as a main component and an iron particle;

subjecting a sintered body after said sintering to hot plastic working in a temperature region in which an α phase and a β phase exist together; and naturally cooling a sintered body after said hot plastic working in an air atmosphere, wherein an area ratio of the β phase containing an iron component is 60% or less of an entire area, a content of iron is 0.5% or more and 7% or less on a weight basis, oxygen is contained in both said α phase and said β phase in a solid solution form, and an equiaxed crystal grain is contained in the α phase.

7. The method for producing a Ti—Fe-based sintered alloy material according to claim 6, wherein said hot plastic working is working selected from the group consisting of hot extruding, hot forging, hot rolling, and hot isostatic pressing.

8. The method for producing a Ti—Fe-based sintered alloy material according to claim 6, wherein a cooling velocity in said natural cooling is in a range of 3 degrees/second to 20 degrees/second.

* * * * *